United States Patent [19]

Shimizu et al.

[11] Patent Number: 4,876,676

[45] Date of Patent: Oct. 24, 1989

[54] VOICE RECOGNIZING ALARM TIMEPIECE

[76] Inventors: Hiroshi Shimizu; Yoshito Yamaguchi, both of 496, Ohbusuma, Showa-machi, Kitakatsushika-gun, Saitama, Japan

[21] Appl. No.: 311,106

[22] Filed: Feb. 15, 1989

[30] Foreign Application Priority Data

Feb. 29, 1988 [JP] Japan ..... 63-27444[U]

[51] Int. Cl.[4] ..... G04B 21/08; G04B 23/00

[52] U.S. Cl. ..... 368/63; 368/73; 368/262

[58] Field of Search ..... 368/63, 72–74, 368/250, 251, 262

[56] References Cited

U.S. PATENT DOCUMENTS 3,855,574 12/1974 Welty ..... 368/262

4,408,096 10/1983 Washizuka et al. ..... 368/63

FOREIGN PATENT DOCUMENTS 5830695 2/1983 Japan ..... 368/63

*Primary Examiner*—Vit W. Miskà

*Attorney, Agent, or Firm*—Koda and Androlia

[57] ABSTRACT

A timepiece whose functions are controlled by making a voice instead of operating manual switches. Operating signals for functioning the timepiece, except for turning off of the alarm sound, are applied to a voice recognizing circuit. Operation of turning off of the alarm sound is performed by detecting a volume level of voice which is made by the user. Thus, it eliminates difficulty to recognize only the voice of the user while the alarm sound is generated because the voice of the user and the alarm sound are mixed together.

2 Claims, 3 Drawing Sheets

OSCILLATOR
DIVIDER
TIMING COUNTER
CALENDAR COUNTER
DISPLAY SELECTING CIRCUIT
DISPLAY
COMPARATOR
ALARM MEMORY
SOUND GENERATING CIRCUIT
S Q R
VOICE RECOGNIZING CIRCUIT
W IN R
DECODER
TIMING SIGNAL GENERATING CIRCUIT
MEMORY
COMPARATOR
A/D CONVERTER
Ø1
Ø2
Ø3
2
4
6
8
10
12
14
16
18
20
22
24
26
28
30
32
34
36
38
44
46
48
50
52
54
56

VOICE RECOGNIZING ALARM TIMEPIECE

BACKGROUND OF THE INVENTION

1. Field of the Invention

The present invention relates to a voice recognizing alarm timepiece which is capable of operating turning on and off of alarm by voice.

2. Description of the Prior Art

There has been offered such method that the alarm function is controlled by a voice recognization technology as shown in the Japanese Patent Laid-Open Publication No. 57-35787. With the method of this Patent Laid-Open Publication, the operation of alarm set (alarm turn on) and alarm off (alarm turn off) is performed by voice from a remote position without touching a timepiece.

The conventional voice recognization technology is to convert the waveform detected by a microphone or the like into digital data. A voice recognization circuit checks whether the detected digital data coincide with the digital data representing stored voice waveforms.

Accordingly, the voice waveform must be detected by the microphone as accurately as possible. However, the exact voice waveform cannot be obtained when alarm sound is generated, because the voice detected by the microphone for turning off the alarm is mixed with the alarm sound. As a result, it was difficult to turn off the alarm sound by the voice recognization circuit in the prior art.

SUMMARY OF THE INVENTION

The present invention is designed to overcome such disadvantage of the prior art. In this intention, the timepiece includes a timing circuit which counts the current time, an alarm circuit which outputs a coincident signal when the current time counted by said timing circuit coincides with a predetermined time, a sound generating circuit which generates sound upon receiving said coincident signal, an alarm control circuit which controls whether said coincident signal is prevented from being supplied to said sound generating circuit or not, a microphone which detects external voice, a voice recognizing circuit which outputs a recognizing signal by recognizing whether said external voice detected by the microphone corresponds to which of the stored voices, a decoder which supplies alarm turn on and off signals to the alarm control circuit, said decoder enables said coincident signal to be supplied to said sound generating circuit at least on receiving said recognizing signal, a low-pass filter which eliminates high frequency components in said voice signal from said microphone, a level detecting circuit which outputs a detective signal whenever the volume level of said voice signal through said low-pass filter is higher than a predetermined value, and a gating circuit which receives said detected signal from said level detector and supplies said alarm off signal to said alarm control circuit only when said coincident signal from said alarm control circuit is supplied to said sound generating circuit.

Accordingly, it is necessary for the user only to make voice in the predetermined volume level higher than that of alarm sound, since the volume level detective method is employed instead of the voice recognization method for turning off the alarm sound.

In addition, the present invention is designed to turn off the alarm by generating voice with volume level higher than that of the alarm sound. For this purpose, the present invention includes a timing signal generating circuit which generates a first timing signal and then generates a second timing signal continuously after generation of said coincident signal by said alarm circuit, an A-D converter which converts the volume level of said voice signal detected by the microphone into digital data, a memory which stores said digital data in response to generation of said first timing signal, and a comparator which outputs a signal in case the digital data from the A-D converter is greater than that of the digital data stored in the memory by comparing said digital data stored in the memory with the digital data from said A-D converter, in response to said second timing signal.

DETAILED DESCRIPTION OF PREFERRED EMBODIMENTS

Figure 1:
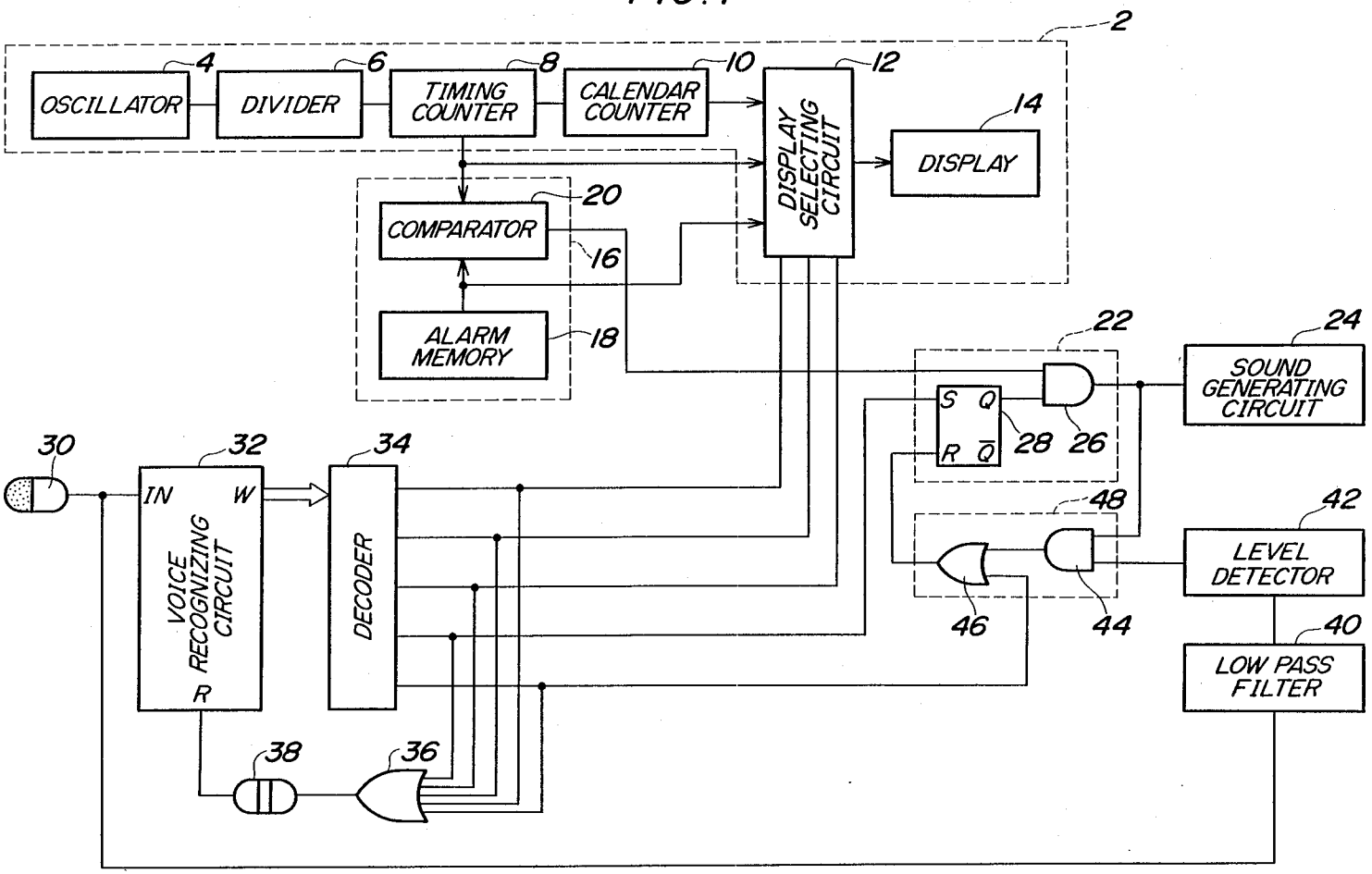
FIG. 1 is a circuit diagram of a voice recognizing alarm timepiece of an embodiment of the present invention.

FIG. 1 is a circuit of voice recognizing alarm timepiece of a preferred embodiment in accordance with the teaching of the present invention. A timing circuit 2 includes an oscilator 4, a divider 6, a timing counter 8 for counting the current time and a calendar counter 10 for counting the day of the week or date and month. A current time signal of the timing counter 8, a counted signal of said calendar counter 10 and an alarm time signal from an alarm circuit which will be described hereinbelow are supplied to a display selecting circuit 12. The circuit 12 applies one input signal which is selected from the three of said input signals to a display 14.

An alarm circuit 16 comprises an alarm memory 18 for storing alarm time, and a comparator 20 for comparing counted values of the alarm memory 18 and the timing counter 8, said comparator 20 outputs the coincident signal when the counted value of the alarm memory 18 coincides with that of the timing counter 8.

An alarm control circuit 22 controls a sound generating circuit 24 to determine whether or not said circuit 24 be activated by supplying said coincident signal thereto. The coincident signal is supplied to one of input terminals of an AND gate 26 having its output terminal being connected to the sound generating circuit 24 and another input terminal is connected to a Q output of flip-flop (hereinafter called FF) 28.

On the other hand, a microphone 30 for detecting external voice is connected to a voice recognizing circuit 32. The voice recognizing circuit 32 supplies a recognizing signal which indicates to a decoder 34 whether the detected voice waveform from the microphone 30 coincides with one of the stored voice waveforms or not. The decoder 34 converts said recognizing signal into an alarm turn on signal, an alarm turn off signal or a display selecting signal. The display selecting signal is supplied to the display selecting circuit 12 and makes the circuit 12 to select one of the output signals of the timing counter 8, the calendar counter 10 and the memory 18. As a result, if, for example, the user makes voice "time", the display 14 displays the current time, and if the user makes voice "calendar", the display 14 displays the day of the week or the date and the month.

On the other hand, the alarm turn on signal and the alarm turn off signal are supplied to a set input S and a reset input R respectively in the alarm control circuit 22. For example, if the voice "alarm set" to activate the alarm is generated, the alarm turn on signal from a decoder 34 becomes H level, the Q output signal of the FF 28 becomes H level and the AND gate 26 is opened, and the coincident signal is supplied to the sound generating circuit 24.

Also, for example, if the voice "alarm nonset" is generated so as not to activate the alarm, the alarm turn off signal becomes H level and the Q output signal of the FF 28 becomes L level. As a result, the AND gate 26 is closed, and the coincident signal is prevented from being supplied to the sound generating circuit 24, and the circuit 24 becomes not to be activated.

Turn off and on operations of the alarm are completed as mentioned above. However, since the output signal of the decoder 34 is supplied to the reset input R of the voice recognizing circuit 32 through an OR gate 36 and a delay circuit 38, the voice recognizing signal is output during a predetermined period of time, and the display selecting signal, the alarm turn on signal and turn off signal become H level during only a predetermined period of time, too.

In this embodiment, the timepiece is designed to turn off the alarm at a predetermined volume level when it is difficult to detect the voice signal by the microphone 30 for turning off the alarm because of the alarm sound being generated. Accordingly, the invention includes a low-pass filter 40 for eliminating high frequency components in the voice signal which is detected by the microphone 30 and a level detector 42 for detecting whether or not the amplitude of the voice signal, in other words, the volume level, through the low-pass filter 30, is higher than a predetermined level exceeding the level of the alarm sound, and outputting H level signal when the volume level of the voice signal is higher than the predetermined level. The detected signal of H level is supplied to an AND gate 44 with output signal from the alarm control circuit 22, and the output signal from the AND gate 44 is supplied to the reset intput R through an OR gate 46 with the alarm turn off signal. As a result, the detected signal of H level from the level detector 42 is supplied to the reset input R of the FF 28, and the alarm is turned off, only when the output signal of the alarm control circuit 22 becomes H level, or, in other words, the alarm sound is generated. In this embodiment, a gating circuit 48 comprises the AND gate 44 and the OR gate 46.

According to the embodiment, it is only necessary for the user to generate the voice which volume level is higher than the predetermined volume level and has to speak loud enough to operate circuits when the user tries to turn off the alarm. As a result, the user can turn off the alarm reliably and easily.

Figure 2:
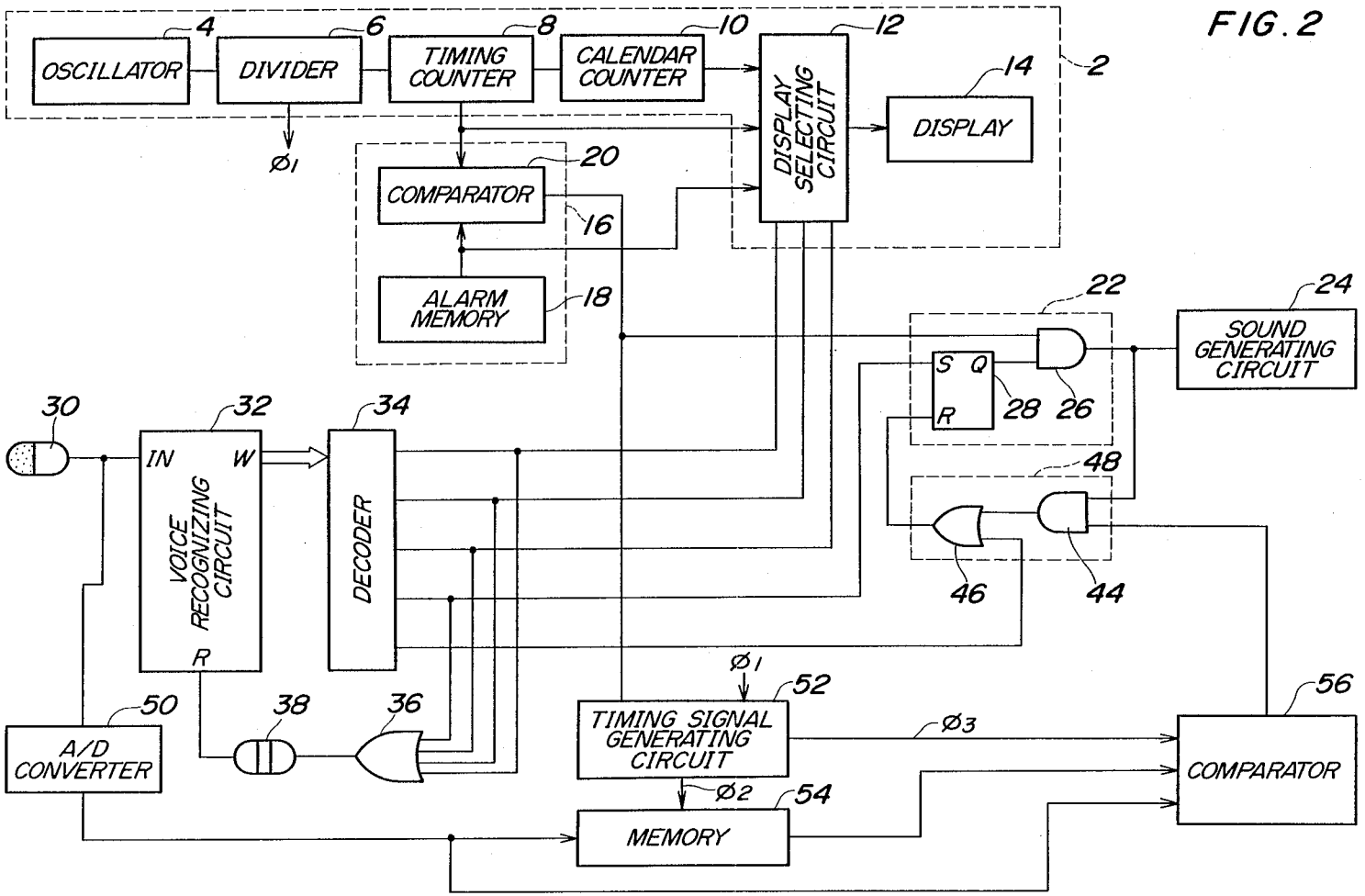
FIG. 2 is a circuit diagram of a voice recognizing alarm timepiece of another embodiment of the present invention.
Figure 3:
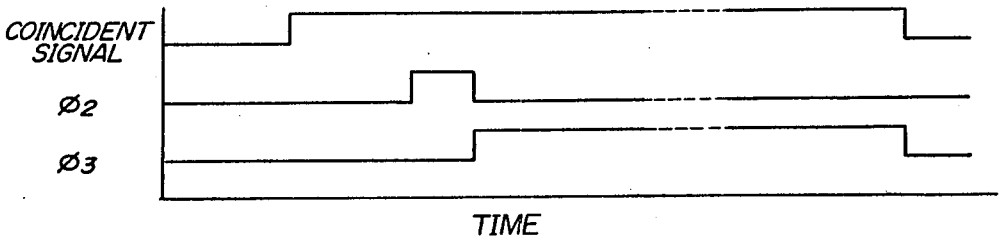
FIG. 3 is a timing chart illustrating the operation of the timepiece shown in FIG. 2.

FIG. 2 is a circuit of the voice recognizing alarm timepiece of another embodiment of the present invention, and FIG. 3 is a timing chart which shows the operation of the cirucit shown in FIG. 2. In FIG. 2, the same members as shown in FIG. 1 are denoted by the same reference numerals and the descriptions thereof are omitted. In this embodiment, the sound signal (analog signal), which is detected by the microphone 30, is converted by an A-D converter 50 into digital values showing the volume level. A timing signal generating circuit 52 generates a first timing signal $\phi_2$ upon receiving a predetermined time period signal $\phi_1$ from the divider 6 when the coincident signal, namely, the alarm sound, is generated, and generates a second timing signal $\phi_3$ which becomes H level as soon as the signal $\phi_2$ falls to L level. During the time when the first timing signal $\phi_2$ is at H level, a memory 54 stores the data from the A-D converter 50. After that, both digital data corresponding to the volume level from the A-D converer 50 and the memory 54 are supplied to a comparator 56. The comparator 56 is activated when the second timing signal $\phi_3$ becomes H level, and outputs the detected signal which becomes H level when the digital data from the A-D converter 50 is higher than that from the memory 54, that is, the volume level of the voice is higher than the volume level stored in the memory 54. The detected signal is supplied to the gating circuit 48 and is converted into the alarm turn off signal, similar to the embodiment of FIG. 1.

In the above-mentioned embodiment of FIG. 2, the volume level of voice to turn off the alarm is stored in the memory in advance, and if the voice is higher than the stored volume level, the alarm will be turned off. In other words, it is necessary for the user only to make a little higher voice than alarm sound and the user need not to make too high voice unduly. Since the timing for generating the timing signals $\phi_2$ and $\phi_3$ is changeable easily, the timing can be applied to any kind of waveform of the alarm sound, and it is only necessary to adjust the period of the first timing signal $\phi_2$ to such period that the volume level of the melody sound is maximum, for example, even the melody which is able to alter the volume level can be used as the alarm sound.

In accordance with the present invention, it is easy and reliable to turn off the alarm sound because of employing detection of the volume level to turn off the alarm instead of the voice recognization circuit when it is difficult to recognize the voice because of noise, and it is only necessary for the user to make any voice to make the operation of the alarm off and the user has no need to choose any particular words. With the present invention, the alarm sound is turne off without requiring any complicated operation.

What is claimed is:

1. In a voice recognizing alarm timepiece including a timing cirucit which counts the current time, an alarm circuit which outputs a coincident signal when the current time counted by said timing circuit coincides with a predetermined time, a sound generating circuit which generates a sound by receiving said coincident signal, an alarm control circuit which controls whether to supply said coincident signal to said sound generating circuit or not, a microphone which detects an external voice, a voice recognizing circuit which outputs a recognizing signal by recognizing whether said external voice detected by said microphone corresponds to one of the stored voices or not, a decoder which supplies to said alarm control circuit the alarm turn on signal allowing said coincident signal to be supplied to said sound generating circuit and the alarm turn off signal preventing said coincident signal from being supplied to said sound generating circuit, upon receipt of said recognizing signal, and said timepiece includes:

a low-pass filter which eliminates high frequency components in said voice signal from said microphone;

a level detector which outputs a detected signal whenever the volume level of said voice signal through said low-pass filter is higher than predetermined level; and a gating circuit which receives said detected signal from said level detector and supplies said alarm turn off signal to said alarm control circuit when said coincident signal from said alarm control circuit is supplied to said sound generating circuit.

2. In a voice recognizing alarm timepiece including a timing circuit which counts the current time, an alarm circuit which outputs a coincident signal when the current time counted by said timing circuit coincides with a predetermined time, a sound generating circuit which generates a sound by receiving said coincident signal; an alarm control circuit which controls whether to supply said coincident signal to said sound generating circuit or not, a microphone which detects an external voice, a voice recognizing circuit which outputs a recognizing signal by recognizing whether said external voice detected by said microphone corresponds to one of the stored voices or not, a decoder which supplies to said alarm control circuit the alarm turn on signal allowing said coincident signal to be supplied to said sound generating circuit and the alarm turn off signal preventing said coincident signal from being supplied to said sound generating circuit, upon receiving said recognizing signal, and said timepiece includes:

a timing signal generating circuit which generates a first timing signal and then generates a second timing signal continuously after said coincident signal from said alarm circuit is generated;

an A-D converter which converts the volume level of said voice signal detected by said microphone into digital data;

a memory which stores said digital data by responding to the generation of said first timing signal;

a comparator which outputs a signal when the digital data from said A-D converter is greater than the digital data stored in said memory; and a gating circuit which receives said detected signal from said level detector and supplies said alarm turn off signals to said alarm control circuit when said coincident signal from said alarm control circuit is supplied to said sound generating circuit.

* * * * *